United States Patent [19]

Dietsche

[11] 3,956,109

[45] May 11, 1976

[54] AUTOMATIC SILVERWARE SORTING CONSTRUCTION

[75] Inventor: Robert B. Dietsche, Deerfield, Ill.

[73] Assignee: Avant Industries, Inc., Wheeling, Ill.

[22] Filed: Oct. 24, 1974

[21] Appl. No.: 517,635

[52] U.S. Cl. ..... 209/73; 209/75; 209/97

[51] Int. Cl.[2] ..... B07C 1/10

[58] Field of Search ..... 209/73, 75, 82, 85, 209/90, 97, 98, 99, 101

[56] References Cited

UNITED STATES PATENTS

| | | | |
|---|---|---|---|
| 3,653,507 | 4/1972 | Ettlinger et al. | 209/97 |
| 3,675,770 | 7/1972 | Ettlinger et al. | 209/97 |

FOREIGN PATENTS OR APPLICATIONS

| | | | |
|---|---|---|---|
| 405,874 | 2/1934 | United Kingdom | 209/90 |

*Primary Examiner*—Drayton E. Hoffman
*Assistant Examiner*—Joseph J. Rolla
*Attorney, Agent, or Firm*—McDougall, Hersh & Scott

[57] ABSTRACT

An apparatus for sorting silverware including a hopper for collecting the silverware in bulk amounts and a vibrating bed for gradually discharging the silverwave and conveying it to a sorting stage for dividing the different types of silverware. The sorting stage includes a table defining a barrier against which the silverware is directed. Laterally extending openings are defined by the barrier, and these openings permit the passage of knives past the barrier means. Forks and spoons are held by the barrier means as they are moved over the table and are then dropped onto a structure which separates the forks and spoons. Receptacles are provided for collecting the different types of silverware.

3 Claims, 12 Drawing Figures

AUTOMATIC SILVERWARE SORTING CONSTRUCTION

This invention relates to a construction for automatically feeding, transporting and sorting silverware. The invention will be described with reference to the handling and sorting of silverware in dishwashing operations, and it will be apparent that various features of the invention are applicable to different aspects of these and similar operations.

The apparatus of the invention is primarily concerned with the sorting and handling of silveware, and the invention is particularly applicable to institutions such as schools, restaurants and industrial cafeterias which handle large volumes of silverware to provide efficient service. In the case of many such operations, sorting of tableware is undertaken manually. Attempts have been made to develop structures which will accomplish automatic separation of knives, forks and spoons; however, only unduly expensive or inefficient automatic sorting systems have resulted.

U.S. Pat. Nos. 3,653,507 and 3,675,770, respectively, describe means for sorting silverware as an operation apart from the sorting of other items of tableware. As outlined in these patents, constructions developed for the sorting of general items of tableware are usually not satisfactory from the standpoint of sorting silverware.

As explained in U.S. Pat. No. 3,882,443, entitled "Silverware Feeder Construction", it has been found that mechanisms which work well under regulated conditions, often do not operate efficiently when peak conditions develop. This is of particular concern in silverware sorting constructions since there are inherently peak hours of activity in restaurants and the like and, therefore, efficient sorting during such peak hours is quite important.

The automatic sorting of silverware is desirable for other reasons. Pieces of silverware represent a proportionally higher number when the total amount of all tableware used in a particular institution is considered. Accordingly, efficient handling of the silverware is extremely important from the standpoint of minimizing labor costs and the expense of maintaining a large supply of silverware.

As pointed out in the aforementioned patents, it is also particularly necessary in the case of silverware sorting means to provide a reliable and efficient construction. Thus, silverware pieces are relatively small, and could lead to significant maintenance problems if any of these pieces become jammed. This can lead to lost operating time, and significant increases in expense for the owner of the sorting construction.

One of the problems which develops during peak load periods is the inability of various sorters to handle heavy loads of silverware. In many instances, it is necessary to feed silverware sorters in manually controlled lots since the sorters cannot function properly when fed large amounts of silverware in a relatively short period. The aforementioned U.S. Pat. No. 3,882,443 provides means for overcoming this problem.

One other problem existing with respect to prior constructions is that knives, particularly the thin handle type normally used by large establishments, are difficult to handle. Such knives can at least occasionally pass through slots designed for forks and spoons whereby the knives are not properly sorted. Also prior designs occasionally result in spoons and forks entering openings designed for knives. This can necessitate more complicated sorting means which increases expense and inefficiency.

It is a general object of this invention to provide an improved silverware sorting apparatus.

It is a more particular object of this invention to provide an apparatus of the general type disclosed in said copending application, the apparatus particularly including improved means for separating knives from the balance of the silverware.

It is a further object of this invention to provide a sorter construction which includes improved beds and tables for supporting and moving silverware whereby the operation of the sorting apparatus can be carried out in a highly efficient manner.

These and other objects of this invention will appear hereinafter and for purposes of illustration, but not of limitation, specific embodiments of the invention are shown in the accompanying drawings in which.

Figure 1:
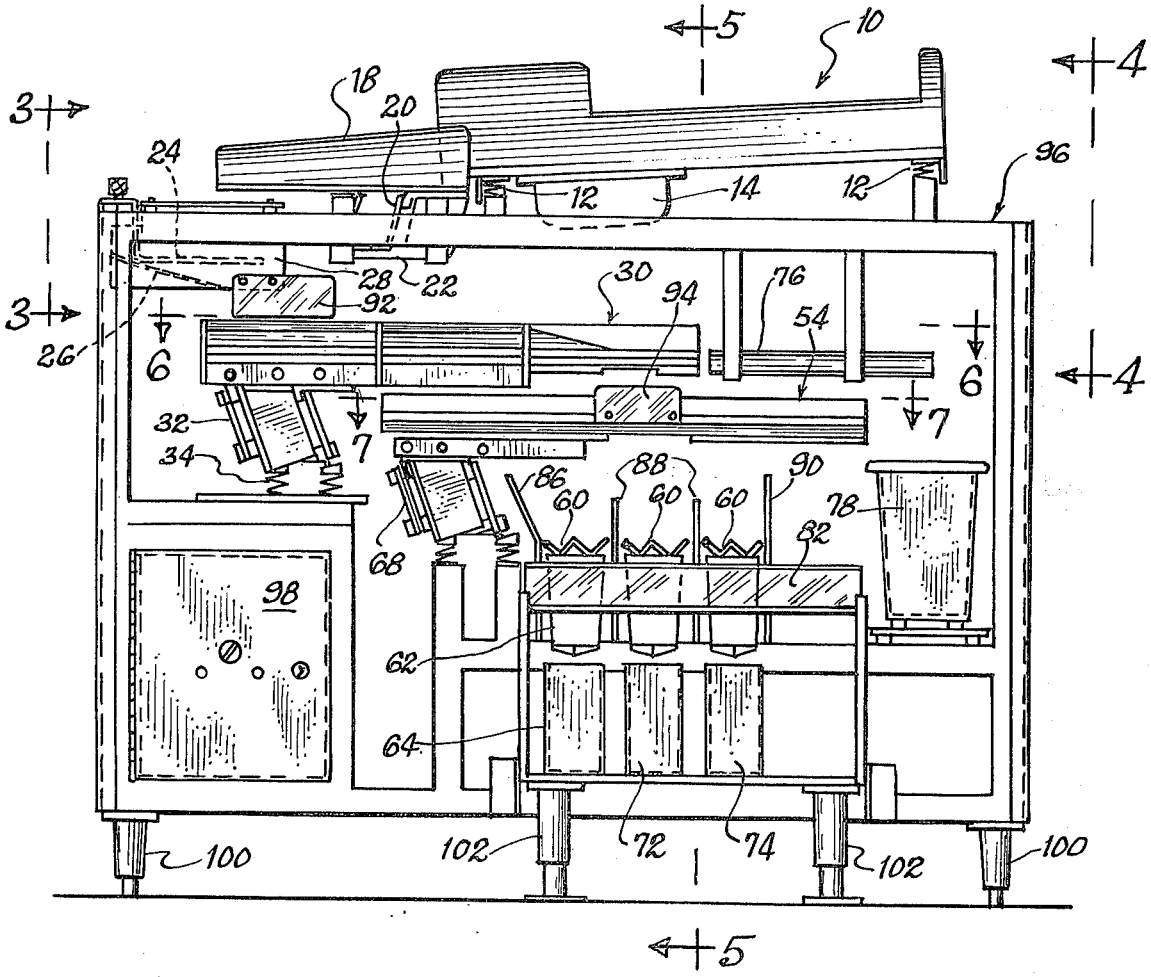
FIG. 1 is a side elevation of an automatic silverware sorting construction characterized by the features of this invention.
Figure 2:
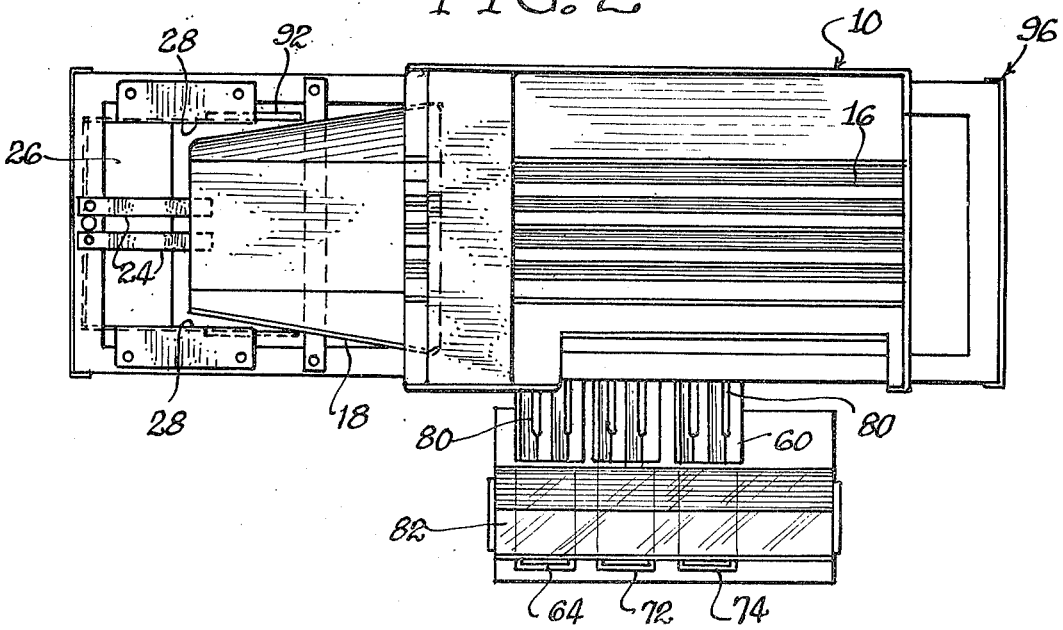
FIG. 2 is a plan view of the construction.
Figure 3:
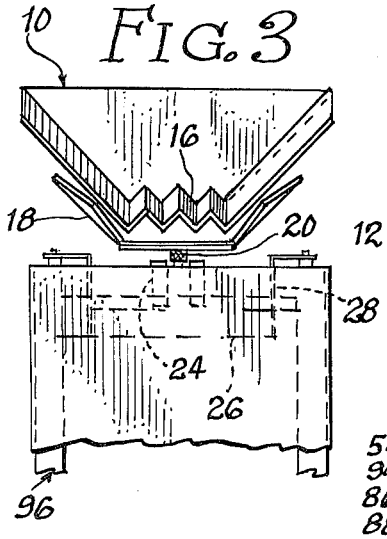
FIG. 3 is a fragmentary elevational view of the construction taken about the line 3–3 of FIG. 1.

This invention generally relates to an apparatus for handling silverware. The apparatus includes means for feeding silverware which is initially collected in bulk. Conveyor mechanisms, preferably having vibrating mounts for achieving the conveying movement, are utilized for delivering the silverware to a sorting mechanism.

The sorting structure employed with the described feeding mechanisms preferably includes features of the type described in the aforementioned U.S. Pat. No. 3,882,443. This structure includes an improved means for separating the silverware specifically spoons of different sizes, and slots are designed so that other silverware, particularly forks, will discharge at a different position.

The construction preferably also includes transfer conveyor means for collecting the individual types of silverware and for conveying these types independently toward a collection area. The use of extrusions which permit highly efficient and economical assembly of the beds is also preferred as explained in said application.

The improvements of this invention are specifically directed to means for increasing the efficiency of separating the individual pieces of silverware. In particular, the invention includes a structure adapted for the separation of knives at an early stage of the sorting operation with the forks and spoons being carried to a separate sorting area subsequent to the separation of the knives.

The particular means for achieving separation of the knives comprise barrier means located on a table structure with all of the silverware being moved against the barrier means. The barrier means are formed with laterally extending openings which permit the passage of knives past the barrier means. The design is such that the forks and spoons are restrained by the barrier means so that these items can continue movement over the table and are then dropped onto a separate structure which sorts the forks and spoons. The respective pieces of silverware are then collected in separate containers for subsequent handling.

The construction illustrated in the accompanying drawings comprises a main hopper 10 for collecting silverware in bulk amounts. In a typical situation, a bus box, rack, washing basket or other means may be utilized for collecting silverware which is then dumped into this hopper. The hopper is mounted on resilient supports 12 and has a vibrator 14 mounted on the underside so that silverware dumped into the hopper will be directed toward the discharge end of the hopper.

The hopper may include a bed portion defining V-shaped grooves 16 as shown particularly in FIGS. 2–5. With this arrangement, the silverware tends to spread in a relatively uniform fashion over the width of the hopper and to align itself parallel with the hopper grooves. If desired, the grooved arrangement may be confined to an area adjacent the end of the hopper.

Beyond the hopper, silverware is conveyed by means of vibrating trough 18. This trough comprises a horizontal pan mounted on flexible members 20 and is provided with a vibrator 22 whereby silverware is conveyed to the discharge end of the trough. Silverware drops from the trough onto horizontally extending arms 24 which tend to separate the silverware which then slides down sloping chute 26. Side plates 28 confine the silverware to the area defined by this chute.

A conveyor bed 30 supported by vibrator 32 and flexible members 34 is located beyond chute 26. Accordingly, silverware is delivered to the bed 30, and this bed carries barrier means 36 which are engaged by all silverware delivered to the bed. In particular, the bed sections 38 are sloped inwardly for purposes of directing the silverware against the sides 40 of the barrier means. The action of the vibrator 32 serves to move the silverware along the sides of the barrier means in addition to assisting in locating the silverware against the side walls 40. The vibration of the bed further tends to create a mixing action of the silverware whereby knives located on the bed will, in particular, be moved immediately adjacent the walls 40 at some point in their movement over the bed 30.

Figure 9:
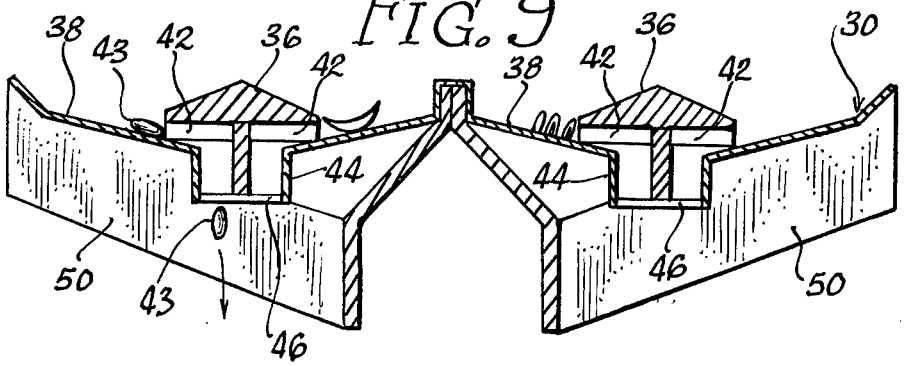
FIG. 9 is an enlarged cross-sectional view taken about the line 9–9 of FIG. 6.
Figure 10:
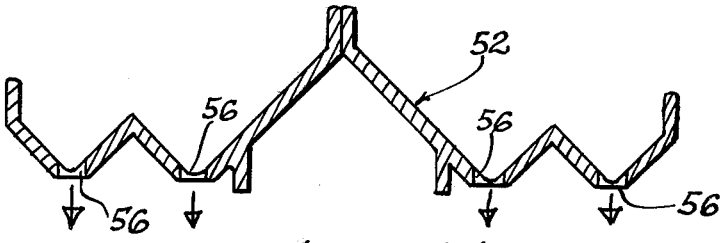
FIG. 10 is an enlarged cross-sectional view taken about the line 10–10 of FIG. 6.

As particularly shown in FIG. 9, the barrier means define cut-out portions toward their forward ends whereby laterally extending openings 42 are provided on each side of each barrier. These openings 42 are dimensioned so that flat knives of the type normally utilized in large restaurant and cafeteria operations (as shown at 43) will slide through. The bed 30 defines channel sections 44 with the bottoms of the channels being open as shown at 46 in the area of the openings 42. Accordingly, knives which slide through the openings 42 also pass through openings 46 and onto a second bed 54.

As is well-known, forks and spoons of standard design comprise curved sections which results in an effective thickness significantly greater than the thickness of knives. Accordingly, the forks and spoons are unable to pass through the openings 42 and will, therefore, be conveyed along the bed 30 until reaching openings 56 in the forward section 52 of the bed (see FIG. 6). These openings are designed so that both forks and spoons will pass through the bed 30 and onto the bed 54 but at a location downstream from the discharge area of the knives.

The forward section 52 and bed 54 are formed with extrusions as more fully described in the aforementioned application. Gussets 50 are associated with bed 30 for reinforcing this bed.

The provision of barrier walls 40 insures proper alignment of the silverware before the openings 42 are reached. Thus, these walls prevent the handles and ends of forks and spoons from "diving" through the bed 30 when they are passed onto the bed. Once settled on the bed, these items will not pass through the openings 42.

Figure 11:
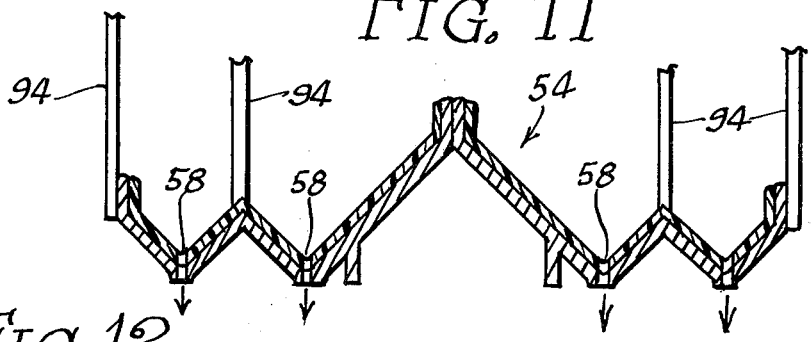
FIG. 11 is an enlarged cross-sectional view taken about the line 11–11 of FIG. 7; and, FIG. 12 is a cross-sectional view illustrating discharge chutes for moving silverware into a collection area after sorting.
Figure 12:
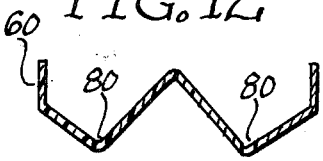

The bed 54 defines V-shaped grooves as shown particularly in FIG. 11 and the bed also defines first openings 58 which are encountered only by knives discharged onto the bed. These openings result in the passage of the knives through the bed 54 and onto one of the collection chutes 60 (FIGS. 1 and 12). A funnel or other passage is provided at 62 whereby the knives will pass into a basket 64 or other container construction.

The forks and spoons are dropped onto the bed 54 in the area of elongated slots 66 which are also formed at the bottom of the V-shaped grooves. The slots 66 are dimensioned so that the handles of both forks and spoons will pass through the slots and the ends of the forks will also pass through; however, the spoon bowls have an effective thickness such that they cannot pass through. Accordingly, the spoons are suspended by the slots 66 but are moved along the bed due to the vibratory action imparted by vibrator 68. V-shaped slot sections 70 are formed at the ends of slots 66, and these slots are designed so that the spoon bowls will pass through the bed 54 at this point.

As shown in FIG. 1, collection baskets 72 and 74 are positioned for receiving, respectively, forks and spoons which are discharged onto chutes 60 from the bed 54.

The structure of the invention is, as noted, generally related to the subject matter of U.S. Pat. No. 3,882,443 and, in that connection, it will be noted that the provision is made in that patent for sorting of spoons with bowls of different sizes. It will be understood that the concepts so-disclosed are applicable to the bed 54 whereby separation of spoons of different sizes can be accomplished in addition to separation of the spoons, knives and forks.

Figure 6:
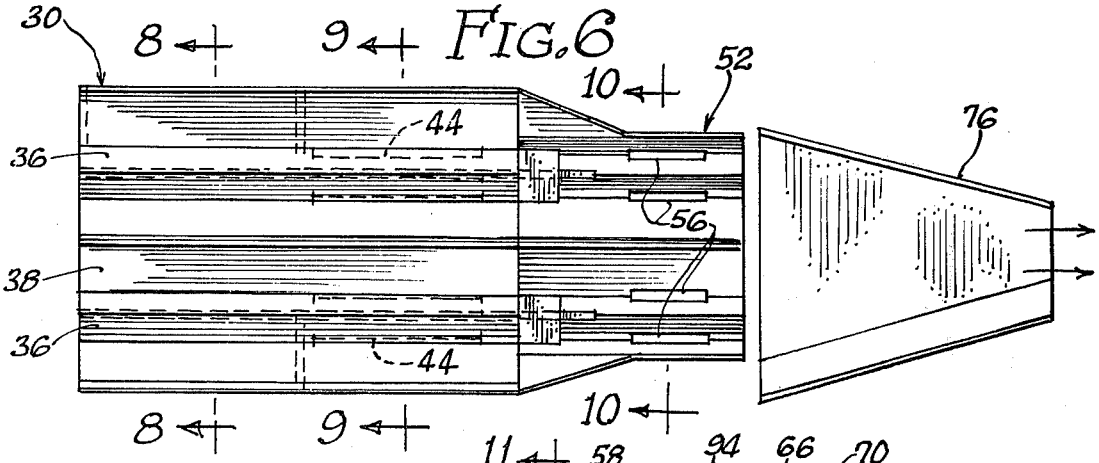
FIG. 6 is a fragmentary, horizontal sectional view taken about the line 6–6 of FIG. 1.
Figure 7:
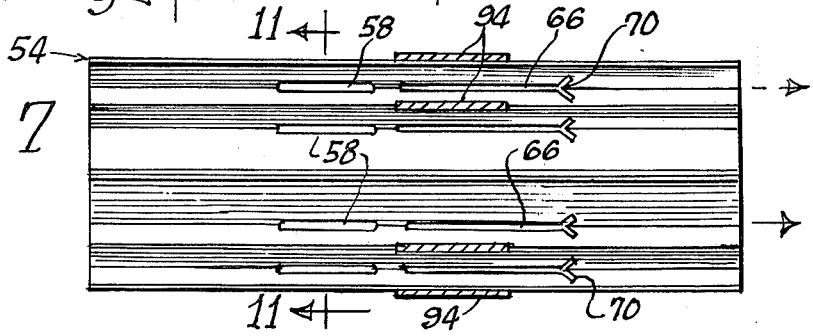
FIG. 7 is a fragmentary, horizontal sectional view taken about the line 7–7 of FIG. 1.
Figure 8:
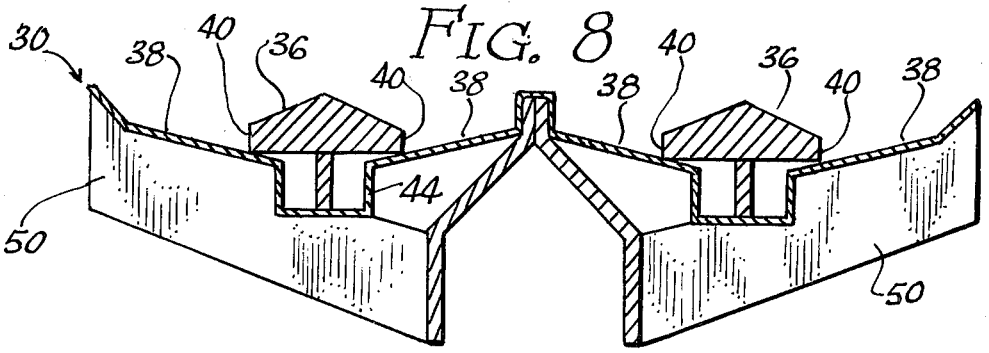
FIG. 8 is an enlarged cross-sectional view taken about the line 8–8 of FIG. 6.

The structure illustrated herein includes other features which result in a highly efficient operatng system. Referring to FIGS. 1 and 6, a pan 76 is positioned at the end of bed 30 whereby all silverware which fails to pass through openings 42 and 56 can be collected. This silverware can either be manually sorted or returned to the hopper 10. Provision is also made for spillage from bed 54 into container 78 which is also illustrated in FIG. 1.

Figure 5:
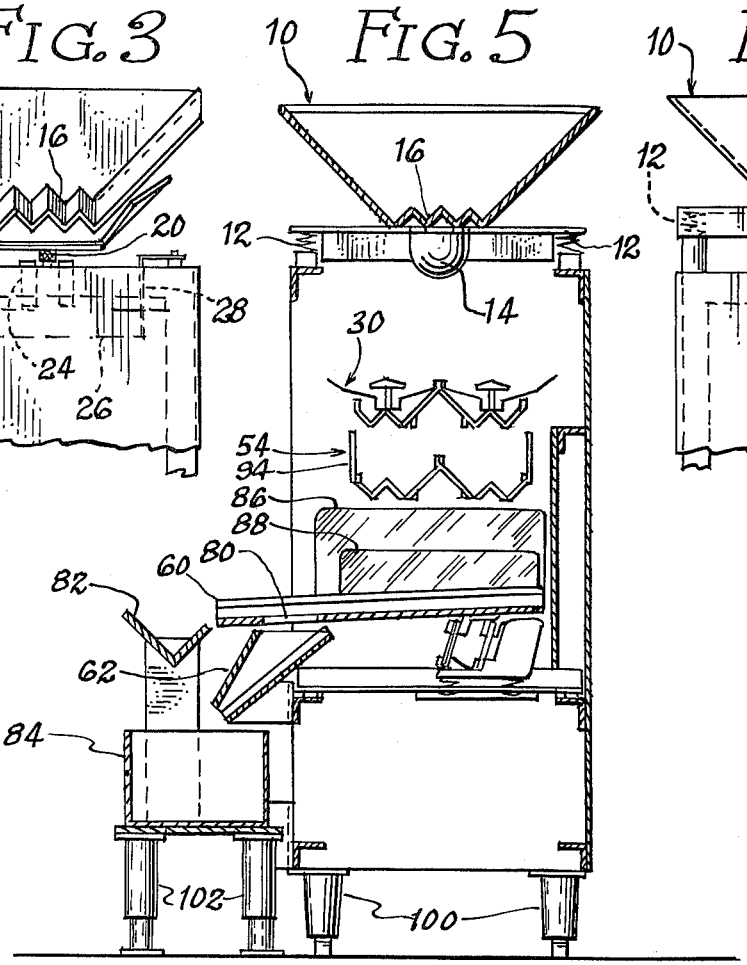
FIG. 5 is a cross-sectional view of the construction taken about the line 5–5 of FIG. 1.
Figure 4:
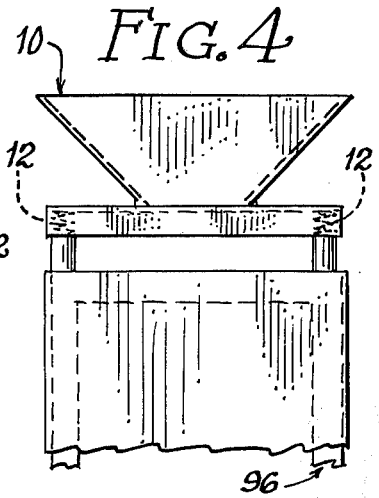
FIG. 4 is a fragmentary elevational view of the construction taken about the line 4–4 of FIG. 1.

As best shown in FIGS. 1 and 5, the chutes 60 define openings 80 for purposes of passing silverware from the chutes into funnels 62. A trough 82 is positioned at the ends of the chutes for purposes of collecting any silverware which falls to pass through openings 80, and a container 84 is provided for receiving this spillage.

In order to reduce the noise of the equipment operation, it is preferred that the various conveyor structures be formed of a laminated material as is best illustrated in FIG. 11. This material comprises extruded metal having a plastic coating whereby metal-to-metal contact is avoided. Since plastic of high wearing ability is available, this reduction in noise can be accomplished along with completely suitable operatng life for the equipment.

The illustrated structure includes utilization of shields 86, 88 and 90 as shown best in FIGS. 1 and 5. These shields are preferably formed of a durable transparent plastic material whereby the sorted silverware can be confined to the desired location and whereby visibility will not be impaired. Thus, an operator can readily see if any equipment malfunctions are causing the silverware pieces to be collected in the wrong areas. This determination can be made at the earliest point of the operation possible so that corrections can be quickly made. Where other shields are employed, for example as shown at 92, in connection with the side plates 24 and at 94 in connection with bed 54, transparent plastic is also preferably employed.

The operating portions of the structure of the invention are, as indicated, suitable for mounting on a unitary frame designated generally by the numeral 96. By reversing the direction of silverware flow from the hopper 10 to the beds 30 and 54, the construction is maintained relatively compact. The frame is also suitable for supporting a vault 98 whereby tools or other valuables associated with the equipment can be secured. Levelers 100 and 102 are associated with the frame so that the mounting can be adjusted to accommodate floor variations and to insure correct disposition of the operating elements of the construction. As noted above and in the aforementioned U.S. Pat. No. 3,882,443, the use of vibrating mechanisms greatly enhances the operating efficiency of the construction and maximum utilization of such mechanisms is achieved with a sytem of the type illustrated herein.

It will be understood that various changes and modifications may be made in the above described construction which provide the characteristics of the invention without departing from the spirit thereof.

That which is claimed is:

1. In a sorting apparatus for silverware consisting of knives, forks and spoons including a conveyor bed, and means moving the silverware from one location to another over said bed, the improvement comprising barrier means disposed on said bed for engagement by the silverware, said barrier means comprising at least one member disposed substantially centrally on said bed and extending longtitudinally of said bed and having a pair of substantially vertically extending side walls on opposite sides of the barrier means, said bed sloping downwardly and inwardly toward said side walls whereby said silverware is caused to move against said side walls, said means for moving the silverware comprising vibrating means associated with said bed for moving said silverware along said bed and into engagement with said side walls, openings defined by each side wall of said barrier means said openings being dimensioned so that the knives are adapted to pass through the openings, the curvature of the spoons and forks imparting an effective width thereto and the dimensions of said opening being less than said effective width so that the spoons and forks will not pass through the openings, means for collecting knives passing through the bed comprising a channel disposed beneath said barrier means, said knives being directed through said openings into said channel, and further openings defined by said channel for the passage of knives beyond the channel, a second bed positioned beneath said first mentioned bed, said knives being collected on said second bed, and openings defined by said second bed for the passage of said knives through said second bed, and means for receiving knives passed through said second bed, and wherein said first mentioned bed extends over said second bed to a position beyond said openings in said second bed, at least one additional opening defined by said first bed dimensioned for the passage of forks and spoons therethrough, said forks and spoons being discharged through said additional opening from said first mentioned bed onto said second bed at a location beyond said openings in said second bed, at least one slot defined by said second bed dimensioned to allow the passage of said forks through the second bed, and means positioned beneath said second bed for collecting said forks.

2. An apparatus in accordance with claim 1 wherein said slot is also dimensioned for the passage of handles of spoons through the second bed with the bowls of said spoons operating to prevent the passage of said spoons through said second bed whereby said spoons are suspended on the second bed, means for moving the spoons along said slot, and an additional opening defined by said second bed as a continuation of said slot, said additional opening being dimensioned to permit the passage of said spoon bowls through said second bed, and means for collecting said spoons.

3. In a sorting apparatus for silverware consisting of knives, forks and spoons including a conveyor bed, and means moving the silverware from one location to another over said bed, the improvement comprising barrier means disposed on said bed for engagement by the silverware, said barrier means comprising at least one member disposed substantially centrally on said bed and extending longitudinally of said bed and having a pair of substantially vertically extending side walls on opposite sides of the barrier means, said bed sloping downwardly and inwardly toward said side walls whereby said silverware is caused to move against said side walls, said means for moving the silverware comprising vibrating means associated with said bed for moving said silverware along said bed and into engagement with said side walls, vertically extending openings defined by each side wall of said barrier means, said openings commencing at locations in the walls downstream of a forward location where said silverware is initially received, said barrier means thereby blocking movement of silverware from said forward location to the commencing locations of the openings whereby the silverware becomes longitudinally aligned with said walls before reaching said opeings, said openings being dimensioned so that the knives are adapted to pass through the openings, the curvature of the longitudinally aligned spoons and forks imparting an effective width thereto and the vertical dimensions of said openings being less than said effective width so that said walls continue blocking the spoons and forks, means for collecting knives passing through the bed comprising a channel disposed beneath said barrier means, said knives being directed through said openings into said channel, and further openings defined by said channel for the passage of knives beyond the channel and into collecting means for the knives, and separate means located beyond said openings for collecting said spoons and forks.

* * * * *